US005791939A

United States Patent [19]

Tanigawa

[11] Patent Number: 5,791,939

[45] Date of Patent: Aug. 11, 1998

[54] SHIELDED CONNECTOR

[75] Inventor: Fumiyoshi Tanigawa, Yokkaichi, Japan

[73] Assignee: Sumitomo Wiring Systems, Ltd., Japan

[21] Appl. No.: 674,804

[22] Filed: Jul. 3, 1996

[30] Foreign Application Priority Data

Jul. 7, 1995 [JP] Japan ..... 7-196068

[51] Int. Cl.[6] ..... H01R 9/03

[52] U.S. Cl. ..... 439/610; 439/607

[58] Field of Search ..... 439/92, 98, 470, 439/471, 607, 610, 587, 905

[56] References Cited

U.S. PATENT DOCUMENTS 4,650,270 3/1987 Tajima et al. ..... 439/607
5,222,909 6/1993 Nomura et al. ..... 439/610 X
5,628,653 5/1997 Haas et al. ..... 439/607

FOREIGN PATENT DOCUMENTS 5-258801 10/1993 Japan .

*Primary Examiner*—Khiem Nguyen
*Attorney, Agent, or Firm*—Banner & Witcoff, Ltd.

[57] ABSTRACT

A connector (10M,10F) has a housing (11M,11F) of insulating material, a terminal (45M,45F) within the housing (11M,11F) and a shielding cover (30) for the housing (11M,11F). The terminal (45M,45F) is adapted to be connected (e.g. by crimping) to a core wire (Wa) of a cable (W); the shielding cover (30) is adapted to be connected (e.g. by crimping) to a shielding layer (Wb) of a cable (W). The shielding cover (30) is movable from a first condition in which the cover (30) is spaced from the housing (11M,11F) and a second condition in which the cover (30) is engaged with the housing (11M,11F).

13 Claims, 7 Drawing Sheets

FIG. 3
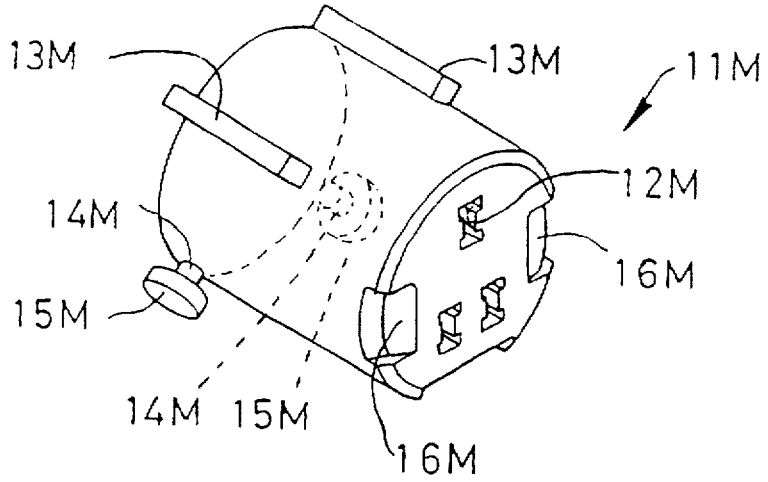
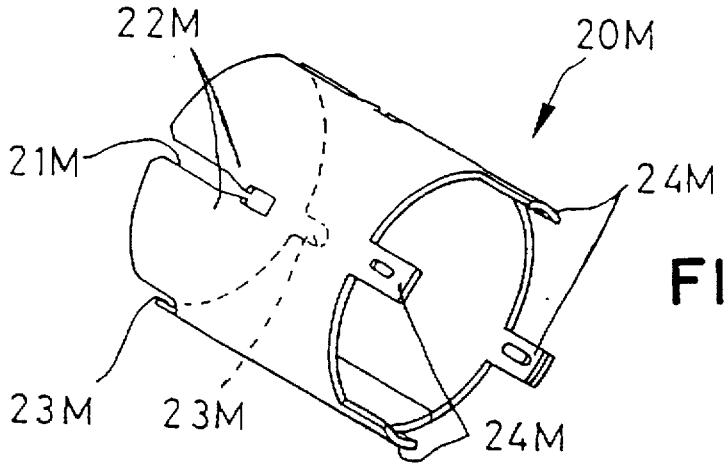
FIG. 4
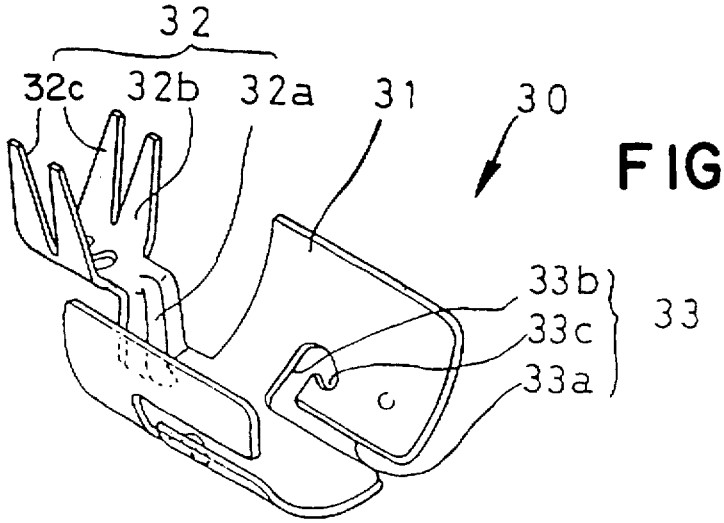
FIG. 5

SHIELDED CONNECTOR

FIELD OF THE INVENTION

The present invention relates to a shielded connector, particularly, but not exclusively, for attachment to a shielded multi-core cable.

Conventionally, a shielded connector comprises a housing of insulating material in which terminals of male or female type are retained, a metal shielding cover for the housing and an outer casing. The cover is crimped on the shielding layer of a shielded multi-core cable and extends to surround the housing. The terminals are each crimped on a respective core of the cable. In order to insert the terminals, after crimping, into the housing, the exposed length of the cores must exceed the length of the terminals. Accordingly, the length of the connector as a whole is governed by the length of the terminals in that the connector must be at least twice as long as the longest terminal. Since a male terminal has a pin for insertion in a female terminal, the overall length of a male connector can be particularly long.

BACKGROUND OF THE INVENTION

An object of the present invention is to provide a shielded connector which is more compact than shielded connectors of the conventional type.

SUMMARY OF THE INVENTION

According to the invention there is provided an electrical connector for a shielded electrical cable, said connector having a housing of insulating material, an electrically conducting terminal within the housing and a shielding cover for the housing, wherein the terminal is adapted to be connected to a core wire of a cable and the shielding cover is adapted to be connected to the shield of a cable, the housing and shielding cover being relatively movable from a first condition in which the housing and cover are spaced apart to a second condition in which the cover overlaps the housing.

In the first condition the housing is spaced from the cover for assembly purposes, and in the second condition, the cover and housing are drawn together into a compact arrangement. The overall length of the connector is thereby reduced.

Preferably, the terminal is adapted to be crimped onto a core wire of a cable. The cover may be adapted to be crimped onto a shielding layer of a cable.

In a preferred embodiment, the connector further comprises a conductive shell about the housing. In the second condition, the shell and cover may establish an electrical contact therebetween.

Preferably, one of the housing and the cover comprises a lug engageable in a channel of the other of the housing and the cover, thereby retaining the housing and cover in engagement. The lug and channel may form a bayonet type fitting. Preferably, the lug is provided on the housing.

The housing is preferably of plastics material, and in the preferred embodiment is moulded.

The cover may be tubular but is preferably arcuate. An arcuate cover allows access to cores of cable with the cover and housing in the second condition.

The connector preferably further comprises a casing which retains the housing and cover therein. The casing is preferably tubular and has an aperture for receiving a mating connector.

Preferably, in the second condition, a core wire of a terminal is folded in the cover, and the resilience thereof urges the cover and housing apart. This urging action may be used to retain the cover and housing in engagement, for example when a bayonet fitting is used.

BRIEF DESCRIPTION OF THE INVENTION

A specific and preferred embodiment of the present invention will now be described by way of example only, with reference to the drawings in which:

FIG. 3 shows a perspective view of a housing of a male connector;

FIG. 4 shows a perspective view of a male shielding shell;

FIG. 5 shows a perspective view of a shielding cover;

DETAILED DESCRIPTION OF THE INVENTION

Figure 12:
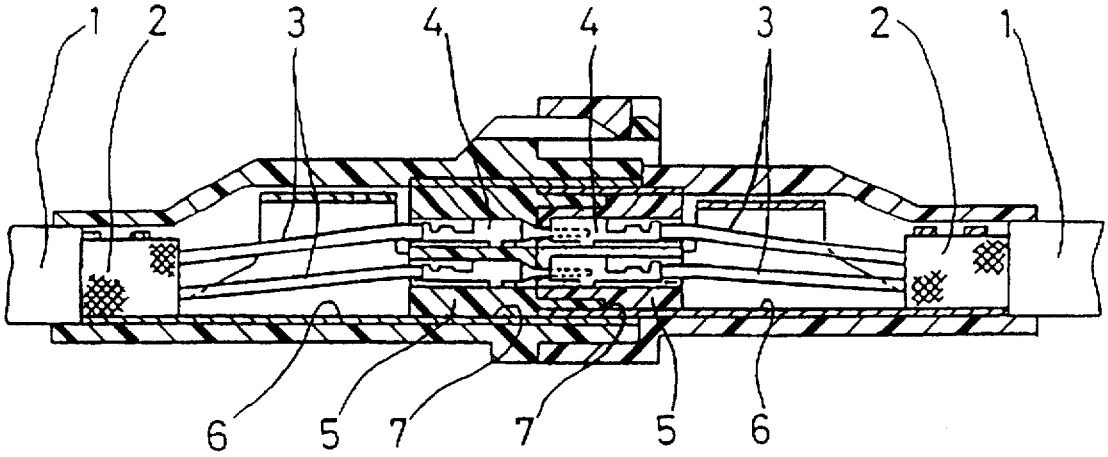
FIG. 12 PRIOR ART
FIG. 12 shows a longitudinal cross-section of prior art shielded male and female connectors.

A conventional shielded connector is shown in FIG. 12. A terminal 4 is connected to the end of a wire core 3 exposed beyond a shielding layer 2 of a shielded electric cable 1. The terminal 4 is inserted into a connector housing 5 which is itself fitted into the outer end 7 of an electrically conductive shielding cover 6. The inner end of the shielding cover is crimped to the shielding layer 2.

In a shielded connector, the terminals 4 are inserted one by one into apertures of the connector housing 5 from the rear. In order to place the second and subsequent terminals 4 in the respective apertures, the length of wire core 3 exposed from the shielding layer 2 must be at least the same as the length of the terminal 4. Accordingly the final connector is rather long, as illustrated, the relatively long exposed wire core 3 being necessary only for assembly reasons.

Male and female connectors 10M, 10F in accordance with the present invention are now described. The connectors fit together in use.

The male connector 10M comprises a cylindrical connector housing 11M of plastics material.

A shielded cable W is provided, comprising a plurality of plastic coated core wires Wa, a tubular shielding layer Wb covering the cores Wa, and an external covering Wc of plastics material surrounding the shielding layer Wb. In the present example, three cores Wa are provided. The shielding layer Wb is formed by intertwining of wires about the cores Wa.

A plurality of cavities 12M extend through the housing 11M parallel with the axis thereof. Male terminals 45M are provided, and each terminal 45M is crimped to a respective core Wa of the shielded cable W. The cable W is prepared for crimping of a terminal 45M to a core Wa thereof by stripping off a length of the external covering Wc to expose the shielding layer Wb, and turning back the shielding layer Wb to expose the cores Wa. Each terminal 45M is housed in a cavity 12M by insertion from a rear side of the housing 11M.

The male terminal 45M includes a pin 46M for insertion in a female terminal 45F of the female connector 10F. The pin 46M extends from the front side of the housing when the terminal 45M is inserted in the cavity 12M.

After insertion of the first terminal 45M into the housing 11M, it is necessary to manoeuvre the second and subsequent terminals 45M into the insertion position on the rear side of the housing 11M. Consequently the length of wire core Wa which must be exposed from within the shielding layer Wb to allow such manoeuvring into position is greater than the length of the terminal 45M.

Two axially extending ribs 13M are formed on the external periphery of the housing 11M. The ribs 13M extend from the rear side of the housing 11M, for approximately half the length thereof, and an angle of about 90° is subtended at the longitudinal axis of the housing.

Two fitting projections 14M project radially from the external periphery of the housing 11M, adjacent the rear end thereof. The fitting projections 14M are each substantially diametrically opposite a respective rib 13M. Each fitting projection 14M has a lateral projection 15M extending from the end thereof distal the housing 11M. As shown in FIG. 3, the lateral projection 15M is disc-shaped.

The front face of the housing 11M has two position-fixing rectangular recesses 16M defined therein. The recesses 16M each extend from the circumference of the face and are diametrically opposed.

A tubular metal shielding shell 20M is fitted coaxially over the housing 11M, and has substantially the same length as the housing 11M. The shell 20M has an internal diameter substantially the same as the external diameter of the housing 11M and is resiliently fitted over the housing 11M. Blind guide slots 21M extend from the rear end of the shell 20M, corresponding to the ribs 13M. Accordingly, when the shell 20M is fitted onto the housing 11M, the ribs 13M fit into the guide slots 21M. When the end of each rib 13M which is farthest the rear face of the housing 11M abuts the blind end of the respective slot, the shell 20M is properly aligned on the housing 11M with the respective ends of the housing 11M and shell 20M being flush. As a result, movement of the shell 20M relative the housing 11M beyond the correct position is prevented. The slots 21M are formed with inwardly projecting teeth 22M which engage the ribs 13M to prevent removal of the shell 20M from the housing 11M.

Two cut-outs 23M are formed in the rear end of the shell 20M to accommodate the fitting projections 14M. Four contact tabs 24M extend axially from the front end of the shell 20M; the tabs 24M are equispaced.

A shielding cover 30 is formed from sheet metal material. As shown in FIG. 5, the cover 30 comprises a semi-cylindrical main body 31 and a crimping member 32 extending from a rear end of the main body 31. The interior diameter of the main body 31 is substantially the same as the external diameter of the shell 20M.

Fitting slots 33 extend from the front end (i.e. the end opposite the crimping member 32 of the main body 31, and corresponding to the fitting projections 14M of the housing 11M. Each fitting slot 33 comprises an axially extending insertion portions **33*a*, a transverse medial portion 33*b* and a return portion 33*c* substantially perpendicular to or at an acute angle to the medial portion 33*b*. Accordingly, the fitting projections 14M of the housing 11M and the fitting slots 33 of the cover 30** define a bayonet type fitting.

The crimping member 32 comprises an in-turn portion **32*a* which extends radially inwardly, and a barrel member 32*b* comprising crimping teeth 32*c*. In use, the shielding layer Wb of a shielded cable W is laid in the barrel member and the crimping teeth 32*c* are crimped thereon to form an electrical contact between the shielding layer Wb and the cover 30. By virtue of the in-turn portion 32*a*, the cable W is substantially co-axial with the cover 30**.

The above-described components of the male connector 10M are housed in a generally tubular casing 40M. Position-fixing projections (not shown in the drawings) are formed on the inner side of the anterior end of the casing 40M. These projections fit with the recesses 16M of the connector housing 11M. By means of the projections engaging with the recesses 16M, the housing 11M is retained from sliding right through the casing 40M. Moreover, a radially internally extending lance 41M prevents removal of the housing 11M from the casing 40M.

The casing 40M has a tubular entry portion 42M at its front end (corresponding to the front end of the housing 11M). The entry portion 42M is adapted to guide and receive a corresponding portion of a female connector 10F therein. Locking holes 43M are formed in the wall of the entry portion 42M to receive corresponding locking portions of the female connector 10F.

The female connector 10F will now be described. It will be appreciated that many parts and features of that connector are substantially the same as those of the male connector 10M. Accordingly, only those features which are not common to both connectors are described. The components of the female connector 10F correspond to respective components of the male connectors, and therefore the suffix 'F' is substituted for 'M' where this is appropriate. The female connector 10F comprises a shielding cover 30 identical to that described above with reference to the male connector, and so further description in relation to that component is omitted.

Figure 8:
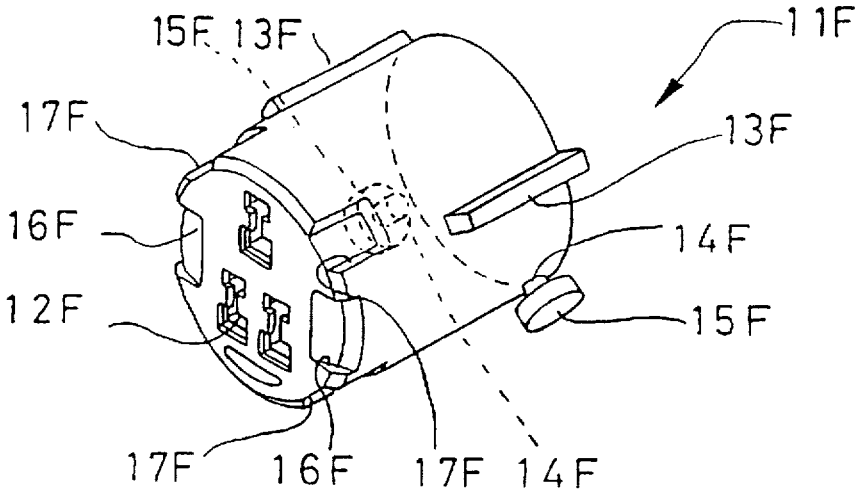
FIG. 8 shows a perspective view of a housing of a female connector.
Figure 9:
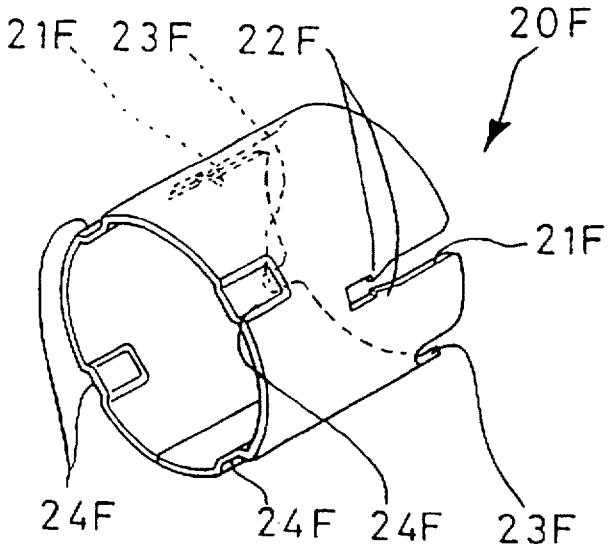
FIG. 9 shows a perspective view of a female shielding shell.
Figure 10:
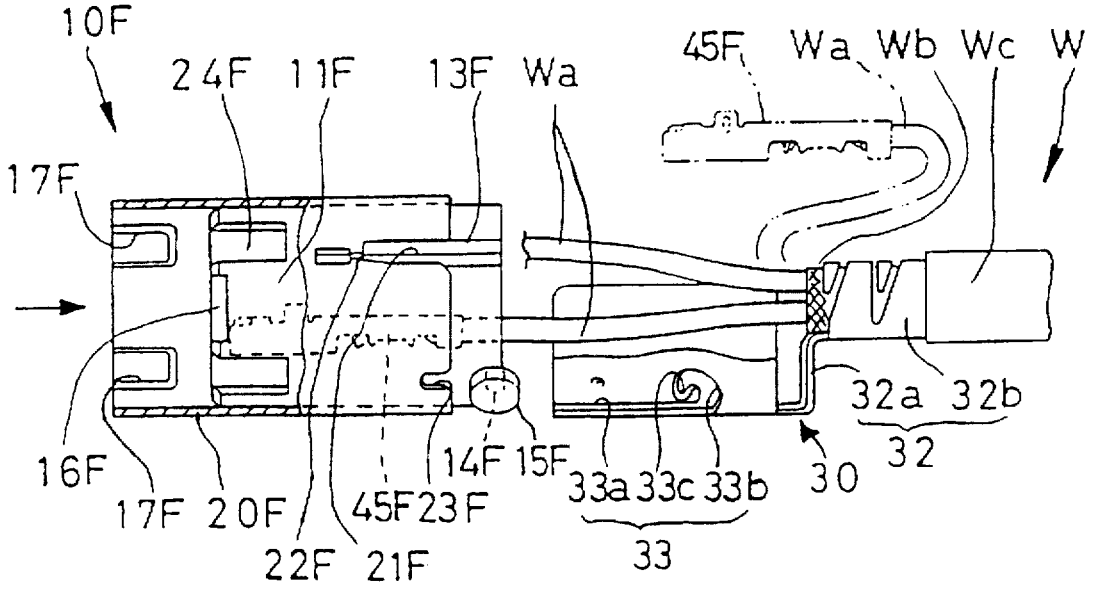
FIG. 10 shows a partially cut-away side view of the female connector of FIG. 1 at a first intermediate assembly stage.
Figure 11:
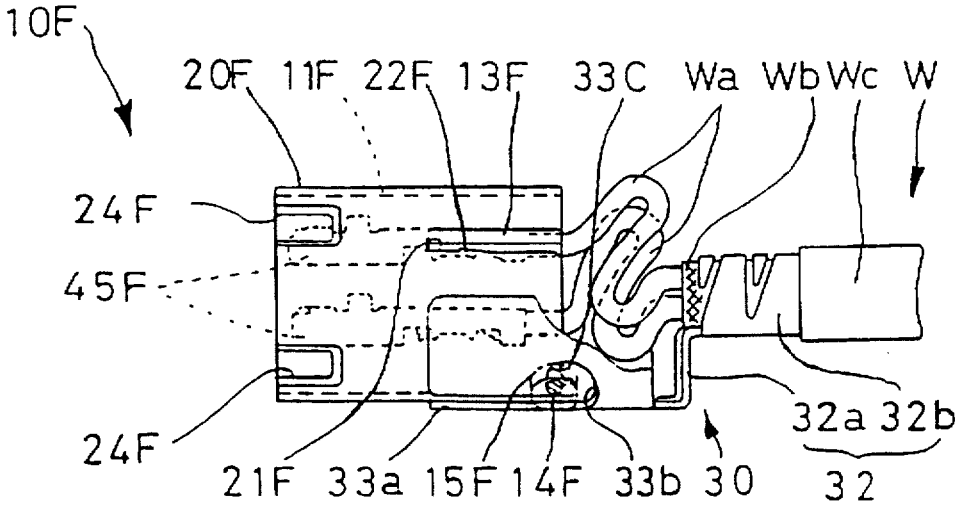
FIG. 11 shows a partially cut-away side view of the female connector of FIG. 1 at a second intermediate assembly stage.

As shown in FIG. 8, the connector housing 11F of the female connector 10F has four indentations 17F defined therein, corresponding to the four contact tabs 24M of the male connector 10M. The shell 20F also has four inward indentations 24F corresponding and locating with the indentations 17F of the housing 11F. The contact tabs 24M and indentations 24F are arranged to engage with each other for electrical contact of the shells 20M, 20F on connection of the two connectors 10M, 10F.

Figure 1:
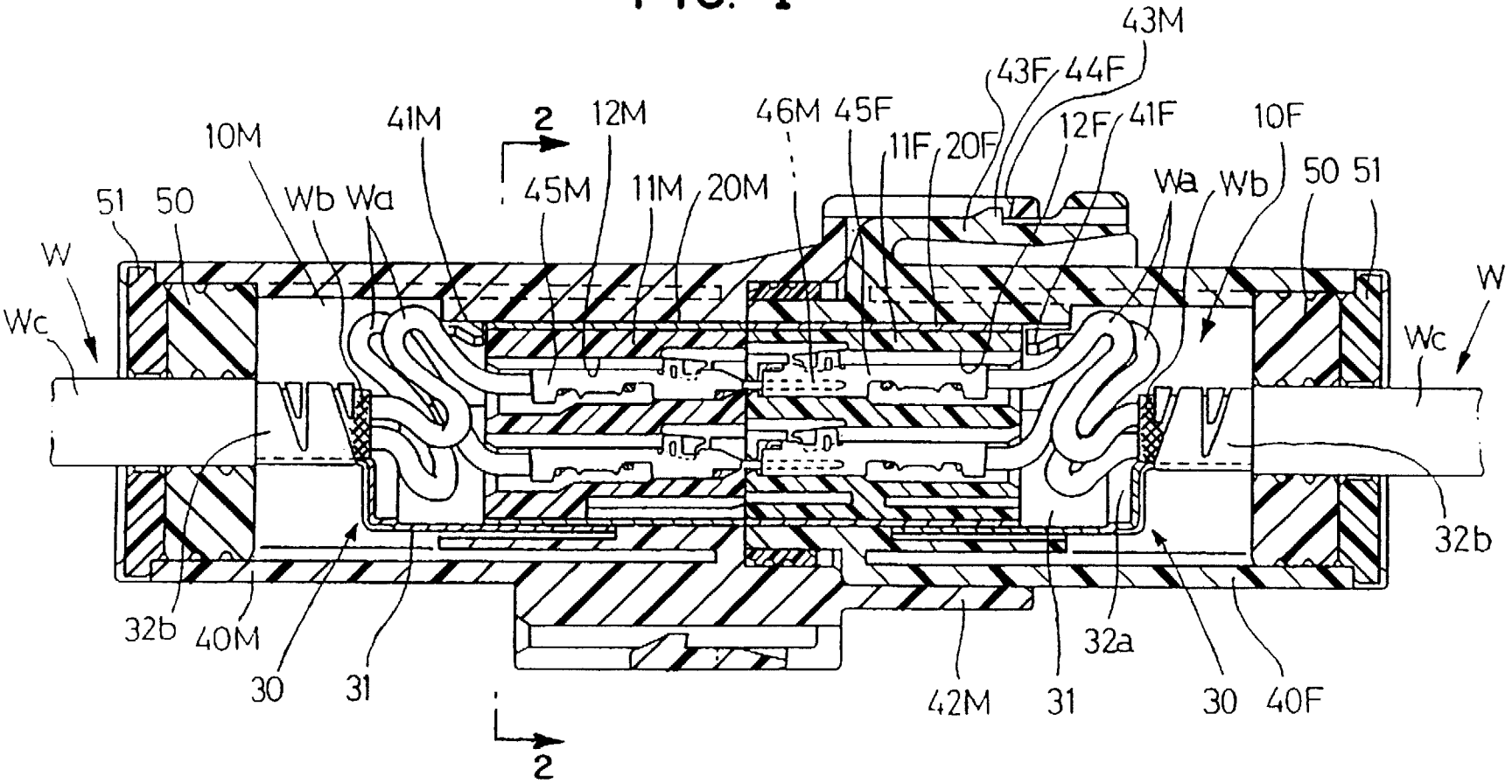
FIG. 1 shows a longitudinal cross section of male and female connectors according to the invention in mutual connection.
Figure 2:
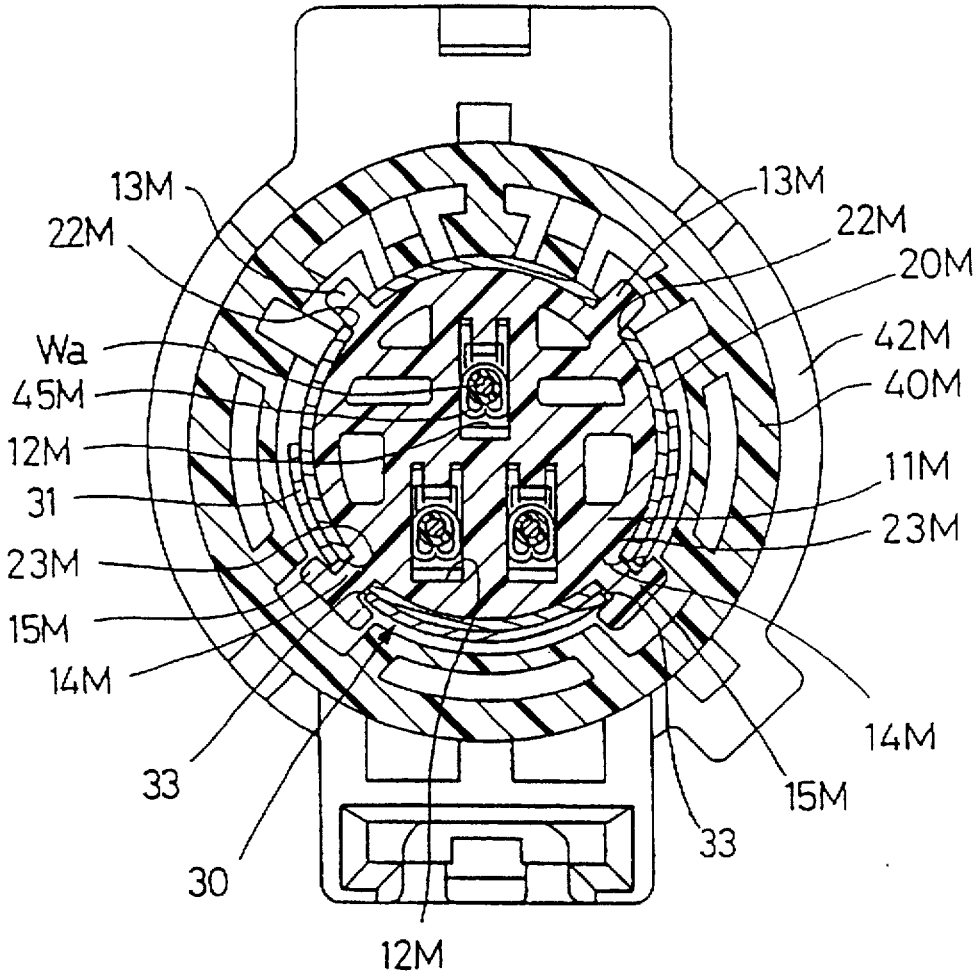
FIG. 2 shows a cross sectional view in the direction indicated A—A in FIG. 1.

As shown in FIG. 1, the casing 40F of the female connector 10F includes a locking arm 43F with a projection 44F adapted to engage the locking hole 43M of the male connector 10M.

Figure 6:
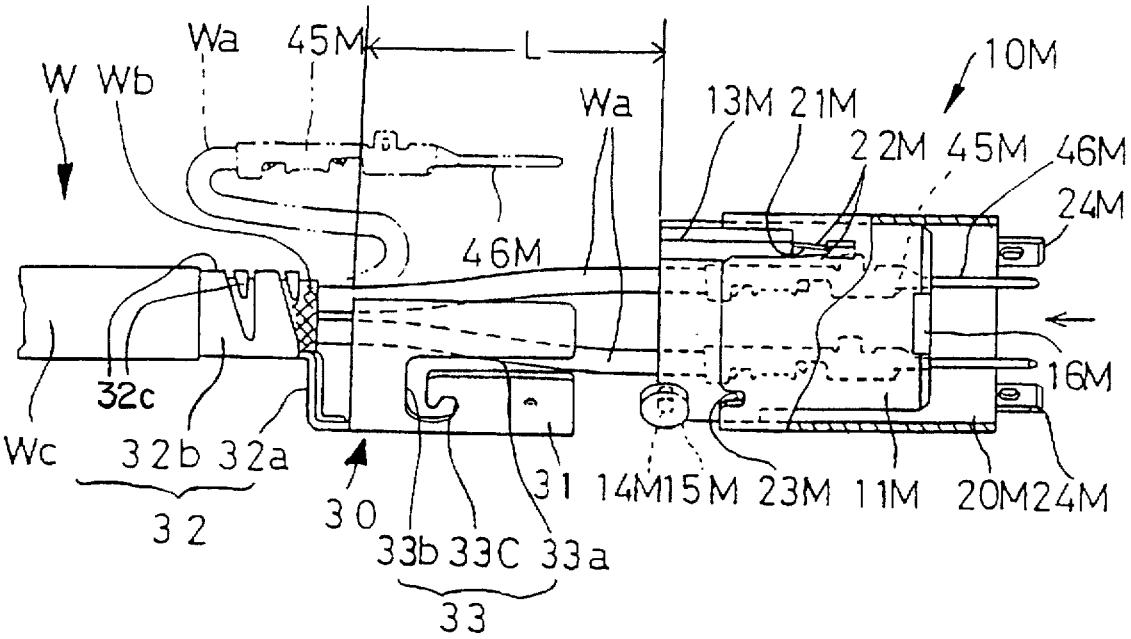
FIG. 6 shows a partially cut-away side view of the male connector of FIG. 1 at a first intermediate assembly stage.
Figure 7:
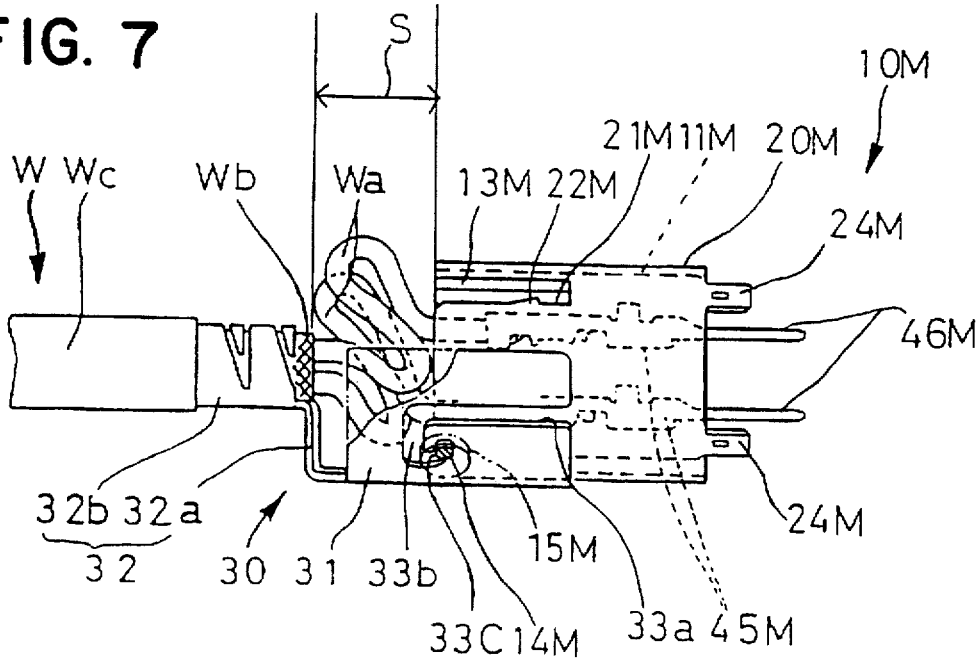
FIG. 7 shows a partially cut-away side view of the male connector of FIG. 1 at a second intermediate assembly stage.

As shown in FIG. 6, assembly of a male connector 10M is performed by firstly crimping a male terminal 45M onto each core Wa of the shielded cable W, secondly crimping the cover 30 to the shielding layer Wb, thirdly inserting each male terminal 45M into the housing 11M, and fourthly drawing the shell 20M and cover 30 together to create engagement by bayonet fit and electrical contact therebetween. The cores Wa will fold during drawing of the shell and cover together, and the resilience of the cores Wa tends to retain the bayonet fitting of the shell 20M and cover 30 by urging them axially apart. FIG. 6 illustrates the connector after the third step, and FIG. 7 after the fourth step.

By folding the core Wa, the overall length of the connector can be reduced. For example, in FIG. 7, the core Wa is illustrated as occupying length S of the longitudinal length of the connector 10M, which is substantially less than the overall exposed length L of the core Wa.

After assembly in the specified manner, the assembly is placed in the casing 40M. Water seals 50 and 51 which were pre-threaded on the cable Wa are inserted in the rear end of the casing 40M. An O-ring can be inserted to seal the entry portion.

The female connector 10F is assembled in corresponding manner. In the same way, the female connector 10F is of substantially reduced length relative to other connectors since the cores Wa are folded: the length S occupied by the core Wa after assembly is less than the length L occupied by the core Wa before assembly.

Even though, in the specified embodiment, the main body 31 of the cover 30 is semi-cylindrical, and so the wire core Wa is not totally shielded, the fact that the cores are all folded and compacted in a small space means that such incomplete shielding does not significantly adversely affect the performance of the connector. Alternatively the main body 31 could be completely tubular. Furthermore, the shielding shells 20M, 20F could be omitted and the shielding covers 30 be increased in length so as to directly shield the housings 11M, 11F.

I claim:

1. An electrical connector for a shielded electrical cable having a shielding layer and a core wire, said connector having a housing of insulating material, an electrically conducting terminal within the housing and a shielding cover for the housing, wherein the terminal is connectable with said core wire and the shielding cover is connectable with said shielding layer, the housing and shielding cover being relatively movable from a first condition in which the housing and cover are spaced apart to a second condition in which the cover overlaps the housing, wherein one of the housing and the cover includes a projection engageable in a channel of the other of the housing and the cover, and the projection and channel constitute a bayonet fitting.

2. The connector of claim 1 wherein the housing has an electrically conductive outer shell.

3. The connector of claim 2 wherein in the second condition, an electrical contact is established between the cover and the shell.

4. The connector of claim 1 wherein the housing and cover are engageable in the second condition.

5. The connector of claim 1 wherein the housing is cylindrical and the cover is arcuate.

6. The connector of claim 1 further comprising a casing which receives and retains the housing and cover therein.

7. The connector of claim 1 and further including a shielded electrical cable attached thereto, the core wire of the cable being foldable in the second condition to exert a resilient force which, in use, urges the cover and housing apart.

8. The connector of claim 3 wherein the housing and cover are engageable in the second condition.

9. The connector of claim 8 wherein one of the housing and the cover includes a projection engageable in a channel of the other of the housing and the cover.

10. The connector of claim 9 wherein the projection and channel constitute a bayonet fitting.

11. The connector of claim 10 wherein the housing is cylindrical and the cover is arcuate.

12. The connector of claim 11 further comprising a casing which receives and retains the housing and cover therein.

13. The connector of claim 12 and further including a shielded electrical cable attached thereto, the core wire of the cable being foldable in the second condition to exert a resilient force which, in use, urges the cover and housing apart.

* * * * *